US010280494B2

(12) United States Patent
Yurko et al.

(10) Patent No.: US 10,280,494 B2
(45) Date of Patent: May 7, 2019

(54) ZIRCONIUM (ZR) AND HAFNIUM (HF) BASED BMG ALLOYS

(71) Applicant: Apple Inc., Cupertino, CA (US)

(72) Inventors: James A. Yurko, Maumee, OH (US); Edgar E. Vidal, Littleton, CO (US); Nicholas W. Hutchinson, Toledo, OH (US); Jeffrey L. Mattlin, San Francisco, CA (US); Theodore A. Waniuk, Lake Forest, CA (US)

(73) Assignee: Apple Inc., Cupertino, CA (US)

( * ) Notice: Subject to any disclaimer, the term of this patent is extended or adjusted under 35 U.S.C. 154(b) by 185 days.

(21) Appl. No.: 14/813,862

(22) Filed: Jul. 30, 2015

(65) Prior Publication Data

US 2016/0032435 A1 Feb. 4, 2016

Related U.S. Application Data

(60) Provisional application No. 62/030,921, filed on Jul. 30, 2014, provisional application No. 62/050,605, filed on Sep. 15, 2014.

(51) Int. Cl.
*C22C 1/00* (2006.01)
*C22C 45/10* (2006.01)

(52) U.S. Cl.
CPC ..... *C22C 45/10* (2013.01); *C22C 1/002* (2013.01)

(58) Field of Classification Search
CPC ..... C22C 1/002; C22C 45/10
See application file for complete search history.

(56) References Cited

U.S. PATENT DOCUMENTS

| | | | | |
|---|---|---|---|---|
| 4,564,396 | A | 1/1986 | Johnson et al. | |
| 5,618,359 | A | 4/1997 | Lin et al. | |
| 5,735,975 | A | 4/1998 | Lin et al. | |
| 6,447,550 | B1 | 10/2002 | Hunter et al. | |
| 6,565,772 | B2 | 7/2003 | Hunter et al. | |
| 7,086,963 | B1 * | 8/2006 | Onuki | A63B 53/04 473/342 |
| 7,473,278 | B2 | 1/2009 | Hunter et al. | |
| 7,550,209 | B2 | 6/2009 | Pawar et al. | |
| 7,582,117 | B2 | 9/2009 | Hunter et al. | |
| 7,794,553 | B2 | 9/2010 | Duan et al. | |
| 7,896,926 | B2 | 3/2011 | Hunter et al. | |
| 7,968,209 | B2 | 6/2011 | Pawar et al. | |
| 8,518,193 | B2 | 8/2013 | Duan et al. | |
| 8,556,987 | B2 | 10/2013 | Hunter et al. | |
| 2004/0112475 | A1 * | 6/2004 | Inoue et al. | 148/403 |
| 2008/0190521 | A1 * | 8/2008 | Loffler | C22C 45/10 148/538 |

OTHER PUBLICATIONS

Murakami (Editor), Stress Intensity Factors Handbook, vol. 2, Oxford: Pergamon Press, 1987, 4 pages.

Gu et al., "Crystallization and mechanical behavior of (Hf, Zr)-Ti—Cu—Ni—Al metallic glasses," *Journal of Non-Crystalline Solids*, 2003, Vo. 317, pp. 112-117.

* cited by examiner

*Primary Examiner* — C Melissa Koslow
(74) *Attorney, Agent, or Firm* — Polsinelli PC

(57) ABSTRACT

The disclosure is directed to Zr and Hf bearing alloys that are capable of forming a metallic glass, and more particularly metallic glass rods with diameters at least 1 mm and as large as 5 mm or larger. The disclosure is further directed to Zr and Hf bearing alloys that demonstrate a favorable combination of glass forming ability, strength, toughness, bending ductility, and/or corrosion resistance.

4 Claims, No Drawings

ZIRCONIUM (ZR) AND HAFNIUM (HF) BASED BMG ALLOYS

PRIORITY

The application claims the benefit under 35 U.S.C. § 119(e) of U.S. Provisional Patent Application No. 62/030,921, entitled "Hafnium (Hf) and Zr-Based BMG Alloys," filed on Jul. 30, 2014, and U.S. Provisional Patent Application No. 62/050,605, entitled "Addition and Optimization of Hafnium (Hf) to Zr-Based BMG Alloys," filed on Sep. 15, 2014, both of which are incorporated herein by reference in its entirety.

TECHNICAL FIELD

The disclosure relates to metallic glass-forming alloys incorporating an amount of Hf that are capable of forming a metallic glass.

BACKGROUND

Metallic glass alloys are a class of metal materials that are characterized by their disordered atomic-scale structure in spite of their metallic constituent elements. By comparison, conventional metallic materials typically possess a highly ordered atomic structure. Metallic glass alloys typically possess a number of useful material properties that render them highly effective as engineering materials. For example, metallic glass alloys are generally much harder than conventional metals, and are generally tougher than ceramic materials. In addition, metallic glass alloys are relatively corrosion resistant and unlike conventional glass materials can have good electrical conductivity. The manufacture of metallic glass materials is compatible with relatively simple forming processes, such as injection molding.

Early metallic glass alloys required cooling rates on the order of $10^6$ K/s to remain amorphous, and were thereby limited in the thickness with which they could be formed. More recently, additional metallic glass alloys that are more resistant to crystallization can form metallic glasses at much lower cooling rates, and can therefore be made to be much thicker. These thicker metallic glasses are known as 'bulk metallic glasses" ("BMGs").

Some Zr-based BMG alloys may include small amounts of Hf, but little empirical data exists to describe the effect of Hf on the material properties of BMG alloys. In the context of Zr-based BMG alloys, the inclusion of Hf may indeed enhance material properties such as elastic modulus and yield strength.

BRIEF SUMMARY

The disclosure is directed to an alloy or metallic glass that may include the early transition metals Zr and Hf. In some aspects, the mass ratio of Hf:Zr is at least 1:500. In other aspects, the mass ratio of Hf:Zr is at least 1:450. In other aspects, the mass ratio of Hf:Zr is at least 1:400. In other aspects, the mass ratio of Hf:Zr is at least 1:350. In other aspects, the mass ratio of Hf:Zr is at least 1:300. In other aspects, the mass ratio of Hf:Zr is at least 1:250. In other aspects, the mass ratio of Hf:Zr is at least 1:200. In other aspects, the mass ratio of Hf:Zr is at least 1:150. In other aspects, the mass ratio of Hf:Zr is at least 1:100. In other aspects, the mass ratio of Hf:Zr is at least 1:50. In other aspects, the mass ratio of Hf:Zr is at least 1:25. In other aspects, the mass ratio of Hf:Zr is at least 1:10. In other aspects, the mass ratio of Hf:Zr is at least 1:5. In other aspects, the mass ratio of Hf:Zr is at least 1:2.

The disclosure is also directed to metallic glasses formed of the alloys. In some aspects, metallic glass rods with diameters of at least 1 mm may be formed of the alloys. In other aspects, metallic glass rods with diameters of at least 2 mm may be formed. In other aspects, metallic glass rods with diameters of at least 3 mm may be formed. In other aspects, metallic glass rods with diameters of at least 4 mm may be formed. In other aspects, metallic glass rods with diameters of at least 5 mm may be formed.

In one aspect, the disclosure is directed to an alloy or metallic glass that may include the early transition metals Zr and Hf as well as at least one additional late transition metal (LTM), as represented by the following formula (xo and y denote atomic fractions):

$$(Zr_{1-y}Hf_y)_{1-xo}Z_{xo} \quad (1)$$

where:

y may be at least 0.001; and

Z may be:

Cu with $0.25<xo<0.65$;

Ni with $0.30<xo<0.60$;

Co with $0.25<xo<0.50$; or

Fe with $0.20<xo<0.40$.

In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

In another aspect, the disclosure is directed to an alloy or metallic glass that may include the early transition metals Zr, Hf, and Ti, as well as at least one late transition metal (LTM), as represented by the following formula (x and y denote atomic fractions; a, b, and c denote atomic percentages):

$$Ti_a(Zr_{1-y}Hf_y)_b(Cu_{1-x}(LTM)_x)_c \quad (2)$$

where:

LTM may be a late transition metal in addition to Cu selected from Ni and Co;

y may be at least 0.001;

a may range from about 19 to about 41;

b may range from about 4 to about 21;

c may range from about 49 to about 64;

$2<x\cdot c<14$;

$b<10+(11/17)(41-a)$;

$x\cdot c<8$ when $49<c<50$;

$x\cdot c<9$ when $50<c<52$;

$x\cdot c<10$ when $52<c<54$; and $x\cdot c<12$ when $54<c<56$.

In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

In an additional aspect, the disclosure is directed to an alloy or metallic glass that may include the early transition metals Zr, Hf, Ti, and Nb, at least one late transition metal (LTM), and at least one additional other metal including, but not limited to Al and/or Zn, as represented by the following formula (x, y, and z denote atomic fractions; a, b, and c denote atomic percentages):

$$(Zr_{1-y}Hf_y)_a M_b(ETM)_c(Cu_xFe_{(1-x-z)}(LTM)_z)_{100-a-b-c} \quad (3)$$

where:

y may be at least 0.001;

a may range from about 45 to about 65;

M may be a metal selected from Al and/or Zn in any combination;

b may range from about 5 to about 15;

ETM is an early transition metal chosen from Ti and/or Nb in any combination;

c may range from about 5 to about 7.5;

Fe comprises an atomic percentage of less than 10% of the overall alloys; and the ratio x:z may range from about 1:2 to about 2:1.

In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

In another additional aspect, the disclosure is directed to an alloy or metallic glass that may include the early transition metals Zr, Hf, and Ti, as well as the alkaline earth metal Be, as represented by the following formula (x and y denote atomic fractions; a and b denote atomic percentages):

$$((Zr_{1-y}Hf_y)_{1-x}Ti_x)_a Be_{100-a} \quad (4)$$

where:

y may be at least 0.001;

x may range from about 0.1 to about 0.9; and a may range from about 50% to about 75%.

In this non-limiting example, a may also range from about 55% to about 75%.

In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

In yet another additional aspect, the disclosure may further be directed to an alloy or metallic glass that may include the early transition metals Zr, Hf, and at least one additional ETM; at least one additional late transition metal (LTM); and the alkaline earth metal Be, as represented by the following formula (x and y denote atomic fractions; a1, a2, b1, b2, and c denote atomic percentages):

$$((Zr_{(1-y)}Hf_y)_x Ti_{(1-x)})_{a1}ETM_{a2}Cu_{b1}LTM_{b2}Be_c \quad (5)$$

where:

y may be at least 0.001;

x may range from about 0.05 to about 0.95;

ETM may be an early transition metal in addition to Zr, Ti, and Hf selected from any ETM defined herein above;

LTM may be a late transition metal in addition to Cu selected from any LTM defined herein above;

(a1+a2) may range from about 60 to about 80;

(b1+b2) is from about 2 to about 17.5;

c is at least 15; and

Ni comprises less than about 5% of the total atomic percentage of the alloy.

In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

The disclosure is further directed to a metallic glass having any of the above formulas and/or formed of any of the foregoing alloys.

In various aspects, the alloy may be a commercially available alloy chosen from VITRELOY alloys, VIT601, VIT105, LM1, and LM1b, where the alloy includes Hf such that the mass ratio of Hf:Zr is at least 1:500. In other aspects, the mass ratio of Hf:Zr is at least 1:450. In other aspects, the mass ratio of Hf:Zr is at least 1:400. In other aspects, the mass ratio of Hf:Zr is at least 1:350. In other aspects, the mass ratio of Hf:Zr is at least 1:300. In other aspects, the mass ratio of Hf:Zr is at least 1:250. In other aspects, the mass ratio of Hf:Zr is at least 1:200. In other aspects, the mass ratio of Hf:Zr is at least 1:150. In other aspects, the mass ratio of Hf:Zr is at least 1:100. In other aspects, the mass ratio of Hf:Zr is at least 1:50. In other aspects, the mass ratio of Hf:Zr is at least 1:25. In other aspects, the mass ratio of Hf:Zr is at least 1:10. In other aspects, the mass ratio of Hf:Zr is at least 1:5. In other aspects, the mass ratio of Hf:Zr is at least 1:2.

In one aspect, the alloy may have the following composition, where the alloy includes Hf such that the mass ratio of Hf:Zr is at least 1:500, as represented by the following formula:

$$(Zr_{(1-y)}Hf_y)_{41.2}Ti_{13.8}Be_{22.5}Cu_{12.5}Ni_{10} \quad (8)$$

In one aspect, the alloy may have the following composition, where the alloy includes Hf such that the mass ratio of Hf:Zr is at least 1:500, as represented by the following formula:

$$(Zr_{(1-y)}Hf_y)_{46.75}Ti_{8.25}Be_{27.5}Cu_{7.5}Ni_{10} \quad (9)$$

In one aspect, the alloy may have the following composition, where the alloy includes Hf such that the mass ratio of Hf:Zr is at least 1:500, as represented by the following formula:

$$(Zr_{(1-y)}Hf_y)_{52.5}Ti_5Al_{10}Cu_{17.9}Ni_{14.6} \quad (10)$$

In one aspect, the alloy may have the following composition, where the alloy includes Hf such that the mass ratio of Hf:Zr is at least 1:500, as represented by the following formula:

$$(Zr_{(1-y)}Hf_y)_{58.5}Al_{10.3}Nb_{2.8}Cu_{15.6}Ni_{12.8} \quad (11)$$

In one aspect, the alloy may have the following composition, where the alloy includes Hf such that the mass ratio of Hf:Zr is at least 1:500, as represented by the following formula:

$$(Zr_{(1-y)}Hf_y)_{44}Ti_{11}Cu_{10}Ni_{10}Be_{25} \quad (12)$$

In one aspect, the alloy may have the following composition, where the alloy includes Hf such that the mass ratio of Hf:Zr is at least 1:500, as represented by the following formula:

$$(Zr_{(1-y)}Hf_y)_{56.25}Ti_{13.75}Cu_{6.88}Ni_{5.63}Nb_5Be_{12.5} \quad (13)$$

In one aspect, the alloy may have the following composition, where the alloy includes Hf such that the mass ratio of Hf:Zr is at least 1:500, as represented by the following formula:

$$(Zr_{(1-y)}Hf_y)_{56.25}Ti_{11.25}Cu_{6.88}Ni_{5.63}Nb_{7.5}Be_{12.5} \quad (14)$$

In one aspect, the alloy may have the following composition, where the alloy includes Hf such that the mass ratio of Hf:Zr is at least 1:500, as represented by the following formula:

$$(Zr_{(1-y)}Hf_y)_{21.67}Ti_{43.33}Ni_{7.5}Be_{27.5} \quad (15)$$

In one aspect, the alloy may have the following composition, where the alloy includes Hf such that the mass ratio of Hf:Zr is at least 1:500, as represented by the following formula:

$$(Zr_{(1-y)}Hf_y)_{35}Ti_{30}Cu_{7.5}Be_{27.5} \quad (16)$$

In one aspect, the alloy may have the following composition, where the alloy includes Hf such that the mass ratio of Hf:Zr is at least 1:500, as represented by the following formula:

$$(Zr_{(1-y)}Hf_y)_{35}Ti_{30}Co_6Be_{29} \quad (17)$$

In one aspect, the alloy may have the following composition, where the alloy includes Hf such that the mass ratio of Hf:Zr is at least 1:500, as represented by the following formula:

$$(Zr_{(1-y)}Hf_y)_{11}Ti_{34}Cu_{47}Ni_8 \quad (18)$$

In one aspect, the alloy may have the following composition, where the alloy includes Hf such that the mass ratio of Hf:Zr is at least 1:500, as represented by the following formula:

$$(Zr_{(1-y)}Hf_y)_{57}Nb_5Cu_{15.4}Ni_{12.6}Al_{10} \quad (19)$$

In one aspect, the alloy may have the following composition, where the alloy includes Hf such that the mass ratio of Hf:Zr is at least 1:500, as represented by the following formula:

$$(Zr_{(1-y)}Hf_y)_{55}Cu_{30}Ni_5Al_{10} \quad (20)$$

In any of the aspects represented by any of formulas (8)-(20) herein above, the atomic ratio y may be at least 0.001, corresponding to a mass ratio Hf:Zr of at least 0.002. In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

Additional embodiments and features are set forth in part in the description that follows, and in part will become apparent to those skilled in the art upon examination of the specification or may be learned by the practice of the disclosed subject matter. A further understanding of the nature and advantages of the disclosure may be realized by reference to the remaining portions of the specification and the drawings, which forms a part of this disclosure.

DETAILED DESCRIPTION

The disclosure is directed to alloys, metallic glasses, and methods of making and using the same. In some aspects, the alloys are described as capable of forming metallic glasses having certain characteristics. It is intended, and will be understood by those skilled in the art, that the disclosure is also directed to metallic glasses formed of the disclosed alloys described herein.

Description of Alloys and Metallic Glasses

In various aspects, the disclosure is directed to an alloy or metallic glass that may include the early transition metals (ETMs) Zr and Hf as well as one or more additional ETMs, one or more late transition metals (LTMs), and/or one or more additional metals including, but not limited to, the alkaline earth metal Be, and other metals Al and/or Zn. In one aspect, Hf may be incorporated into the BMG alloys described herein in the form of elemental Hf. By way of non-limiting example, the Hf may be included in any of the alloys described herein above by adding an amount of pure Hf to a Zr-BMG melt. In this example, the amount of Hf may be added to the BMG melt in the form of pure Hf pieces or turnings.

In another aspect the Hf may be incorporated into the BMG alloys in the form of a Zr/Hf alloy with a mass ratio of Hf:Zr at least 1:500. In other aspects, the mass ratio of Hf:Zr is at least 1:450. In other aspects, the mass ratio of Hf:Zr is at least 1:400. In other aspects, the mass ratio of Hf:Zr is at least 1:350. In other aspects, the mass ratio of Hf:Zr is at least 1:300. In other aspects, the mass ratio of Hf:Zr is at least 1:250. In other aspects, the mass ratio of Hf:Zr is at least 1:200. In other aspects, the mass ratio of Hf:Zr is at least 1:150. In other aspects, the mass ratio of Hf:Zr is at least 1:100. In other aspects, the mass ratio of Hf:Zr is at least 1:50. In other aspects, the mass ratio of Hf:Zr is at least 1:25. In other aspects, the mass ratio of Hf:Zr is at least 1:10. In other aspects, the mass ratio of Hf:Zr is at least 1:5. In other aspects, the mass ratio of Hf:Zr is at least 1:2. In this other aspect, incorporation of a Zr/Hf alloy into the BMG alloys may reduce the cost and complexity of production methods compared to the incorporation of purified Zr and purified Hf separately. By way of non-limiting example, Hf may be incorporated into the BMG alloy in the form of a commercial Zr/Hf alloy including, but not limited to ZIRCADYNE 702 alloy (Allegheny Teledyne), which contains Hf ranging from about 0.5 wt % to about 4.5 wt %. In an additional aspect, the commercial Zr/Hf alloy may be combined with an amount of pure Zr crystal bar to produce an amount of Zr/Hf with the desired atomic fraction y as described herein above. In yet another additional aspect, an amount of purified crystal bar Zr may be produced with an amount of Hf retained as an impurity such that the amount of purified crystal bar Zr has the desired atomic fraction y as described herein above.

In various aspects, the atomic ratio y (Hf:Zr) may be at least 0.001, corresponding to a mass ratio of about 1:500 converted to an atomic ratio using the atomic mass of Zr (91.224 g/mol) and the atomic mass Hf (178.49 g/mol). In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

Early Transition Metals (ETMs), as used herein, refer to any one or more elements from Groups 3, 4, 5 and 6 of the periodic table, including the lanthanide and actinide series. The previous IUPAC notation for these groups was IIIA, IVA, VA and VIA. Non-limiting examples of suitable ETMs include: Sc, Ti, Cr, Mn, Y, Zr, Nb, Mo, Hf, Ta, W, Rf, Db, and Sg.

Late Transition Metals (LTMs), as used herein, refer to any elements from Groups 7, 8, 9, 10 and 11 of the periodic table. The previous IUPAC notation was VIIA, VIIIA and IB. Non-limiting examples of suitable LTMs include: Mn, Fe, Co, Ni, Cu, Tc, Ru, Rh, Pd, Ag, Re, Os, Ir, Pt, Au, Hs, Cn, Zn, Cd, and Hg.

In certain embodiments, the alloy or composition may include elements selected from the group consisting of Ti, Ni, Cu, Be, Hf, Nb, V, Al, Sn, Ag, Pd, Fe, Co, Cr, Y, Sc, Gd, Er, B, Si, Ge, C, Pb, and/or any combination thereof, in some instances in an amount up to 0.05 atomic percent, in some instances up to 3 atomic percent, and in some instances up to 5 atomic percent.

In one aspect, the disclosure is directed to an alloy or metallic glass that may include the early transition metals Zr and Hf as well as at least one additional late transition metal (LTM). In one non-limiting example of this aspect, the alloy or metallic glass may be represented by the following formula (xo and y denote atomic fractions):

$$(Zr_{1-y}Hf_y)_{1-xo}Z_{xo} \quad (1)$$

where:

y may be at least 0.001; and

Z may be an LTM chosen from:

Cu with $0.25<xo<0.65$;

Ni with $0.30<xo<0.60$;

Co with $0.25<xo<0.50$; or

Fe with $0.20<xo<0.40$.

In various embodiments, any variation on the above alloys can include any variation of of the alloys described in U.S. Pat. No. 4,564,396, substituting Hf for Zr in any atomic ratio or Hf:Zr mass ratio described herein. For this purpose, U.S. Pat. No. 4,564,396 is incorporated herein by reference in its entirety.

In another aspect, the disclosure is directed to an alloy or metallic glass that may include the early transition metals Zr, Hf, and Ti, as well as at least one late transition metal (LTM). In one non-limiting example of an alloy in accordance with this other aspect, the alloy may be represented by the following formula (x and y denote atomic fractions; a, b, and c denote atomic percentages):

$$Ti_a(Zr_{1-y}Hf_y)_b(Cu_{1-x}(LTM)_x)_c \quad (2)$$

where:

LTM may be a late transition metal in addition to Cu selected from Ni and Co;

y may be at least 0.001;

a may range from about 19 to about 41;

b may range from about 4 to about 21;

c may range from about 49 to about 64;

$2<x\cdot c<14$;

$b<10+(11/17)(41-a)$;

$x\cdot c<8$ when $49<c<50$;

$x\cdot c<9$ when $50<c<52$;

$x\cdot c<10$ when $52<c<54$; and $x\cdot c<12$ when $54<c<56$.

In various embodiments, any variation on the above alloys can include any variation of of the alloys described in U.S. Pat. No. 5,618,359, substituting Hf for Zr in any atomic ratio or Hf:Zr mass ratio described herein. For this purpose, U.S. Pat. No. 5,618,359 is incorporated herein by reference in its entirety.

In another non-limiting example of an alloy in accordance with this aspect, the alloy may be represented by the following formula (x, y, and z denote atomic fractions; a, b, and c denote atomic percentages):

$$((Zr_{1-y}Hf_y)_{1-x}Ti_x)_aCu_b(Ni_{1-z}Co_z)_c \quad (6)$$

where:

y may be at least 0.001;

x may range from about 0.1 to about 0.3;

z may range from about 0 to about 1;

a may range from about 47 to about 67;

b may range from about 8 to about 42;

c may range from about 4 to about 37;

$b\geq 20+(19/10)(a-60)$ when $60<a<67$ and $13<c<32$;

$b\geq 20+(19/10)(76-a)$ when $60<a<67$ and $4<c<13$; and $b\geq 8+(34/8)(55-a)$ when $47<a<55$ and $11<c<37$.

In various embodiments, any variation on the above alloys can include any variation of of the alloys described in U.S. Pat. No. 5,618,359, substituting Hf for Zr in any atomic ratio or Hf:Zr mass ratio described herein. For this purpose, U.S. Pat. No. 5,618,359 is incorporated herein by reference in its entirety.

In an additional aspect, the disclosure is directed to an alloy or metallic glass that may include the early transition metals Zr, Hf, Ti, and Nb, at least one late transition metal (LTM), and at least one additional other metal including, but not limited to, Al and/or Zn. In a non-limiting example of an alloy in accordance with this additional aspect, the alloy may be represented by the following formula (x, y, and z denote atomic fractions; a, b, and c denote atomic percentages):

$$(Zr_{1-y}Hf_y)_aM_b(ETM)_c(Cu_xFe_{(1-x-z)}(LTM)_z)_{100-a-b-c} \quad (3)$$

where:

y may be at least 0.001;

a may range from about 45 to about 65;

M may be a metal selected from Al and/or Zn in any combination;

b may range from about 5 to about 15;

ETM may be an early transition metal in addition to Zr and Hf, chosen from Ti and/or Nb in any combination;

c may range from about 5 to about 7.5;

Fe comprises an atomic percentage of less than 10% of the overall alloy;

LTM may be a late transition metal other than Cu, Fe, and Zn; and the ratio x:z may range from about 1:2 to about 2:1.

In various embodiments, any variation on the above alloys can include any variation of the alloys described in U.S. Pat. No. 5,735,975, substituting Hf for Zr in any atomic ratio or Hf:Zr mass ratio described herein. For this purpose, U.S. Pat. No. 5,735,975 is incorporated herein by reference in its entirety.

In another additional aspect, the disclosure is directed to an alloy or metallic glass that may include the early transition metals Zr, Hf, and Ti, as well as the alkaline earth metal Be. In a non-limiting example of an alloy in accordance with this other additional aspect, the alloy may be represented by the following formula (x and y denote atomic fractions; a denotes an atomic percentage):

$$((Zr_{1-y}Hf_y)_{1-x}Ti_x)_aBe_{100-a} \quad (4)$$

where:

y may be at least 0.001;

x may range from about 0.1 to about 0.9; and a may range from about 50% to about 75%.

In this non-limiting example, a may also range from about 55% to about 75% in an aspect.

In various embodiments, any variation on the above alloys can include any variation of the alloys described in U.S. Pat. No. 8,518,193, substituting Hf for Zr in any atomic ratio or Hf:Zr mass ratio described herein. For this purpose, U.S. Pat. No. 8,518,193 is incorporated herein by reference in its entirety.

In yet another additional aspect, the disclosure may further be directed to an alloy or metallic glass that may include the early transition metals Zr, Hf, and at least one additional ETM; at least one additional late transition metal (LTM), and the alkaline earth metal Be. In a non-limiting example of an alloy in accordance with this aspect, the alloy or metallic glass may represented by the following formula (x and y denote atomic fractions; a1, a2, b1, b2, and c denote atomic percentages):

$$((Zr_{(1-y)}Hf_y)_x Ti_{(1-x)})_{a1}ETM_{a2}Cu_{b1}LTM_{b2}Be_c \quad (5)$$

where:

y may be at least 0.001;

x may range from about 0.05 to about 0.95;

ETM may be an early transition metal in addition to Zr, Ti, and Hf selected from any ETM defined herein above;

LTM may be a late transition metal in addition to Cu selected from any LTM defined herein above;

(a1+a2) may range from about 60% to about 80%; and

Ni comprises less than about 5% of the total atomic percentage of the alloy.

In the alloy of formula (5), other elements may be added to the alloy without significantly altering the alloy properties. Non-limiting examples of suitable other elements include: Sn, B, Si, Al, In, Ge, Ga, Pb, Bi, As and P. Other LTMs including, but not limited to, Co and/or Fe may be substituted for the Cu fraction in the alloy of formula (5) so long as the total amount of Ni in the alloy does not exceed about 5% atomic.

In various embodiments, any variation on the above alloys can include any variation of the alloys described in U.S. Pat. No. 7,794,553, substituting Hf for Zr in any atomic ratio or Hf:Zr mass ratio described herein. For this purpose, U.S. Pat. No. 7,794,553, is incorporated herein by reference in its entirety. In another non-limiting example of an alloy in accordance with this aspect, the alloy may be represented by the following formula (xand y denote atomic fractions; a and b denote atomic percentages):

$$((Zr_{1-y}Hf_y)_{1-x}Ti_x)_aCU_{100-a-b}Be_b \quad (7)$$

where:

y may be at least 0.001; and the alloy may be additionally subject to at least one of the following conditions:

a>60% when b>15%;

x may be equal to about 0.5 when b>15%; or x may be equal to about 0.167 when b>20%.

In various embodiments, any variation on the above alloys can include any variation of the alloys described in U.S. Pat. No. 7,794,553, substituting Hf for Zr in any atomic ratio or Hf:Zr mass ratio described herein. For this purpose, U.S. Pat. No. 7,794,553, is incorporated herein by reference in its entirety. In any of the alloys described herein above, the atomic fraction y, representing the ratio of Zr/Hf atoms in the alloy, may be at least 0.001. In other aspects, y may be at least 0.0011. In other aspects, y may be at least 0.0012. In other aspects, y may be at least 0.0013. In other aspects, y may be at least 0.0014. In other aspects, y may be at least 0.0015. In other aspects, y may be at least 0.002. In other aspects, y may be at least 0.0025. In other aspects, y may be at least 0.003. In other aspects, y may be at least 0.004. In other aspects, y may be at least 0.005. In other aspects, y may be at least 0.01. In other aspects, y may be at least 0.02. In other aspects, y may be at least 0.04. In other aspects, y may be at least 0.05. In other aspects, y may be at least 0.06. In other aspects, y may be at least 0.07. In other aspects, y may be at least 0.08. In other aspects, y may be at least 0.09. In other aspects, y may be at least 0.10. In other aspects, y may be at least 0.20. In other aspects, y may be at least 0.30. In other aspects, y may be at least 0.40. In other aspects, y may be at least 0.50.

In various other aspects, the alloy may be a commercially available BMG alloy to which an amount of Hf is added, resulting in a Hf:Zr mass ratio of at least 1:500. In other aspects, the mass ratio of Hf:Zr is at least 1:450. In other aspects, the mass ratio of Hf:Zr is at least 1:400. In other aspects, the mass ratio of Hf:Zr is at least 1:350. In other aspects, the mass ratio of Hf:Zr is at least 1:300. In other aspects, the mass ratio of Hf:Zr is at least 1:250. In other aspects, the mass ratio of Hf:Zr is at least 1:200. In other aspects, the mass ratio of Hf:Zr is at least 1:150. In other aspects, the mass ratio of Hf:Zr is at least 1:100. In other aspects, the mass ratio of Hf:Zr is at least 1:50. In other aspects, the mass ratio of Hf:Zr is at least 1:25. In other aspects, the mass ratio of Hf:Zr is at least 1:10. In other aspects, the mass ratio of Hf:Zr is at least 1:5. In other aspects, the mass ratio of Hf:Zr is at least 1:2.

Table 1 is a summary of commercially available BMG alloys with Hf added as described herein above, provided by way of non-limiting example.

TABLE 1

Commercial BMG Alloys with Zr and Hf

| BMG Alloy | Maximum Zr (wt %) | Minimum Hf (wt %) |
|---|---|---|
| VIT1B | 67.03 | 0.1341 |
| VIT601 | 62.47 | 0.1249 |
| VIT106A | 70.06 | 0.1401 |
| VIT105 | 65.67 | 0.1313 |

In the disclosure, an alloy described as "entirely free" of an element denotes that not more than trace amounts of the element found in naturally occurring trace amounts may occur in the alloy.

Description of Methods of Processing the Sample Alloys

A method for producing the metallic glasses involves inductive melting of the appropriate amounts of elemental constituents in a quartz tube under inert atmosphere. A method for producing metallic glass rods from the alloy ingots involves re-melting the ingots in quartz tubes with 0.5-mm thick walls in a furnace at 1100° C. or higher under high purity argon. In one aspect, the furnace temperature may range from about 1200° C. to about 1400° C. The melted alloy ingots may be rapidly quenched in a room-temperature water bath. In an aspect, the temperature of the melt prior to quenching may be at least 100° C. above the liquidus temperature of the alloy. In general, amorphous articles produced using alloys according to the disclosure may be produced by (1) re-melting the alloy ingots in quartz tubes of 0.5-mm thick walls, holding the melt at a temperature of about 1100° C. or higher, and particularly between 1200° C. and 1400° C., under inert atmosphere, and rapidly quenching in a liquid bath; (2) re-melting the alloy ingots, holding the melt at a temperature of about 1100° C. or higher, and particularly between 1200° C. and 1400° C., under inert atmosphere, and injecting or pouring the molten alloy into a metal mold, particularly a mold made of copper, brass, or steel.

Material Properties of Alloys and Metallic Glasses

The alloys and metallic glasses formed using the alloys described herein above may possess any one or more of the various material properties described herein below.

Glass-Forming Ability:

In various aspects, the glass-forming ability may be enhanced by the inclusion of Hf in the alloy as described herein above relative to an alloy containing essentially no Hf, corresponding to an atomic ratio y equal to essentially zero. In various aspects, the glass-forming ability may be unchanged by the inclusion of Hf in the alloy as described herein above relative to an alloy containing essentially no Hf, corresponding to an atomic ratio y equal to essentially zero. In the disclosure, the glass-forming ability of each alloy can be quantified by the "critical rod diameter", defined as largest rod diameter in which the amorphous phase (i.e. the metallic glass) can be formed. In some embodiments, the critical rod diameter of the alloy is at least 1 mm. In other embodiments, the critical rod diameter of the alloy is at least 2 mm. In some embodiments, the critical rod diameter of the alloy is at least 3 mm. In some embodiments, the critical rod diameter of the alloy is at least 4 mm. In some embodiments, the critical rod diameter of the alloy is at least 5 mm.

Notch Toughness:

In some embodiments, the notch toughness of the alloys as described herein above may be unchanged as compared to comparable alloys containing essentially no Hf, corresponding to an atomic ratio y equal to essentially zero. In further embodiments, the notch toughness can be lower as compared to comparable alloys containing essentially no Hf, corresponding to an atomic ratio y equal to essentially zero.

In some embodiments, the notch toughness of the alloys as described herein above may be at least 1% higher than comparable alloys containing essentially no Hf, corresponding to an atomic ratio y equal to essentially zero. In another embodiment, the notch toughness of the alloys as described herein above may be at least 2% higher. In another embodiment, the notch toughness of the alloys as described herein above may be at least 5% higher. In another embodiment, the notch toughness of the alloys as described herein above may be at least 10% higher. In another embodiment, the notch toughness of the alloys as described herein above may be at least 20% higher. In another embodiment, the notch toughness of the alloys as described herein above may be at least 40% higher. In another embodiment, the notch toughness of the alloys as described herein above may be at least 50% higher. In another embodiment, the notch toughness of the alloys as described herein above may be at least 100% higher. In another embodiment, the notch toughness of the alloys as described herein above may be at least 200% higher.

The notch toughness, defined as a stress intensity factor at crack initiation $K_q$, is a measure of a material's ability to resist fracture in the presence of a notch. The notch toughness may be characterized as a measure of the work required to propagate a crack originating from a notch. A high $K_q$ indicates that a material exhibits significant toughness in the presence of defects.

The notch toughness of sample metallic glasses may be performed on 3-mm diameter rods. The rods may be notched using a wire saw with a root radius of between 0.10 and 0.13 μm to a depth of approximately half the rod diameter. The notched specimens may be placed on a 3-point bending fixture with span distance of 12.7 mm and carefully aligned with the notched side facing downward. The critical fracture load may be measured by applying a monotonically increasing load at constant cross-head speed of 0.001 mm/s using a screw-driven testing frame. At least three tests may be performed, and the variance between tests is included in the notch toughness plots. The stress intensity factor for the geometrical configuration described herein may be evaluated using known analysis techniques including, but not limited to, the technique described in Murakimi (Y. Murakami, *Stress Intensity Factors Handbook*, Vol. 2, Oxford: Pergamon Press, p. 666 (1987)).

Ductility:

In one embodiment, the ductility of the alloys as described herein above may be unchanged as compared comparable alloys containing essentially no Hf, corresponding to an atomic ratio y equal to essentially zero. In another embodiment, the ductility of the alloys as described herein above may be at least 1% higher than comparable alloys containing essentially no Hf, corresponding to an atomic ratio y equal to essentially zero. In another embodiment, the ductility of the alloys as described herein above may be at least 2% higher. In another embodiment, the ductility of the alloys as described herein above may be at least 5% higher. In another embodiment, the ductility of the alloys as described herein above may be at least 10% higher. In another embodiment, the ductility of the alloys as described herein above may be at least 20% higher. In another embodiment, the ductility of the alloys as described herein above may be at least 40% higher. In another embodiment, the ductility of the alloys as described herein above may be at least 50% higher. In another embodiment, the ductility of the alloys as described herein above may be at least 100% higher. In another embodiment, the ductility of the alloys as described herein above may be at least 200% higher.

Bending ductility is a measure of a material's ability to deform plastically and resist fracture in bending in the absence of a notch or a pre-crack. A high bending ductility indicates that the material may exhibit ductile properties in a bending overload. The ductility may be assessed by placing an intact (i.e. non-notched) sample rod on a 3-point bending fixture. The ductility may be measured by applying a monotonically increasing load at constant cross-head speed of 0.001 mm/s using a screw-driven testing frame.

In various aspects, the metallic glasses according to the disclosure may demonstrate bending ductility. In one aspect, a wire made of a metallic glass described herein and having a diameter of up to about 1 mm may undergo macroscopic plastic deformation under bending load without fracturing catastrophically. In another aspect, the wire may have a diameter of up to 0.5 mm. In another aspect, the wire may have a diameter of up to 0.25 mm. In another aspect, the wire may have a diameter of up to 0.1 mm.

In various embodiments, as Hf is substituted, the yield strength increases and the notch toughness remains unchanged or decreases. The resulting alloy has a smaller plastic zone size, and thus lower ductility.

Elastic Modulus:

The elastic modulus, $\lambda$, is a measure of a material's ability to deform elastically (i.e. non-permanently) during compressive loading. The elastic modulus may be characterized as a slope of a material's stress-strain curve within an elastic range of deformation of the material during compressive loading. A high $\lambda$ indicates that a material exhibits significant resistance to deforming in response to a compressive force. In one embodiment, the elastic modulus of the alloys as described herein above may be at least 1% higher than comparable alloys containing essentially no Hf, corresponding to an atomic ratio y equal to essentially zero. In another embodiment, the elastic modulus of the alloys as described herein above may be at least 2% higher. In another embodiment, the elastic modulus of the alloys as described herein above may be at least 5% higher. In another embodiment, the elastic modulus of the alloys as described herein above may be at least 10% higher. In another embodiment, the elastic modulus of the alloys as described herein above may be at least 20% higher. In another embodiment, the elastic modulus of the alloys as described herein above may be at least 40% higher. In another embodiment, the elastic modulus of the alloys as described herein above may be at least 50% higher. In another embodiment, the elastic modulus of the alloys as described herein above may be at least 100% higher. In another embodiment, the elastic modulus of the alloys as described herein above may be at least 200% higher.

To characterize elastic modulus, compression testing of sample metallic glasses may be performed on cylindrical specimens about 3 mm in diameter and about 6 mm in length by applying a monotonically increasing load at constant cross-head speed of 0.001 mm/s using a screw-driven testing frame. The strain may be measured using a linear variable differential transformer. The elastic modulus may be estimated as the slope of a linear portion of the stress-strain curve corresponding to the elastic deformation region of the sample metallic glasses obtained during compression testing.

Yield Strength:

The compressive yield strength, $\sigma_y$, is a measure of a material's ability to resist non-elastic yielding during compressive loading. The yield strength may be characterized as the stress at which a material yields plastically. A high $\sigma_y$ indicates that a material exhibits significant strength. In one embodiment, the compressive yield strength of the alloys as described herein above may be at least 1% higher than comparable alloys containing essentially no Hf, corresponding to an atomic ratio y equal to essentially zero. In another embodiment, the compressive yield strength of the alloys as described herein above may be at least 2% higher. In another embodiment, the compressive yield strength of the alloys as described herein above may be at least 5% higher. In another embodiment, the compressive yield strength of the alloys as described herein above may be at least 10% higher. In another embodiment, the compressive yield strength of the alloys as described herein above may be at least 20% higher. In another embodiment, the compressive yield strength of the alloys as described herein above may be at least 40% higher. In another embodiment, the compressive yield strength of the alloys as described herein above may be at least 50% higher. In another embodiment, the compressive yield strength of the alloys as described herein above may be at least 100% higher. In another embodiment, the compressive yield strength of the alloys as described herein above may be at least 200% higher.

To characterize compressive yield strength, compression testing of sample metallic glasses may be performed on cylindrical specimens about 3 mm in diameter and about 6 mm in length by applying a monotonically increasing load at constant cross-head speed of 0.001 mm/s using a screw-driven testing frame. The strain may be measured using a linear variable differential transformer. The compressive yield strength may be estimated using the 0.2% proof stress criterion.

Corrosion Resistance:

In one embodiment, the corrosion resistance of the alloys as described herein above may be at least 1% higher than comparable alloys containing essentially no Hf, corresponding to an atomic ratio y equal to essentially zero. In another embodiment, the corrosion resistance of the alloys as described herein above may be at least 2% higher. In another embodiment, the corrosion resistance of the alloys as described herein above may be at least 5% higher. In another embodiment, the corrosion resistance of the alloys as described herein above may be at least 10% higher. In another embodiment, the corrosion resistance of the alloys as described herein above may be at least 20% higher. In another embodiment, the corrosion resistance of the alloys as described herein above may be at least 40% higher. In another embodiment, the corrosion resistance of the alloys as described herein above may be at least 50% higher. In another embodiment, the corrosion resistance of the alloys as described herein above may be at least 100% higher. In another embodiment, the corrosion resistance of the alloys as described herein above may be at least 200% higher.

The corrosion resistance of sample metallic glasses may evaluated by immersion tests in sulfuric acid ($H_2SO_4$ at concentrations of 70-80%, or in heated water/steam. A rod of metallic glass sample with an initial diameter of about 3 mm and a length of about 15 mm may be immersed in a bath of $H_2SO_4$ at room temperature, or in hot water and/or steam. The density of the metallic glass rod may be measured using the Archimedes method and used, along with the measured mass of the rod, to estimate changes in the rod volume due to corrosion over time. The corrosion depth at various stages during the immersion may be estimated by measuring the mass change with an accuracy of ±0.01 mg. The corrosion rate may be estimated assuming linear kinetics.

In various aspects, the metallic glasses according to the disclosure may demonstrate corrosion resistance. In one aspect, the corrosion rate of the metallic glass alloys according to the current disclosure may be less than about 1 mm/year. In another aspect, the corrosion rate of the metallic glass alloys according to the current disclosure may be less than about 0.5 mm/year. In another aspect, the corrosion rate of the metallic glass alloys according to the current disclosure may be less than about 0.25 mm/year. In another aspect, the corrosion rate of the metallic glass alloys according to the current disclosure may be less than about 0.1 mm/year.

Having described several embodiments, it will be recognized by those skilled in the art that various modifications, alternative constructions, and equivalents may be used without departing from the spirit of the disclosure. Those skilled in the art will appreciate that the presently disclosed embodiments teach by way of example and not by limitation. Therefore, the matter contained in the above description or shown in the accompanying drawings should be interpreted as illustrative and not in a limiting sense. Additionally, a number of well-known processes and elements have not been described in order to avoid unnecessarily obscuring the disclosure. The following claims are intended to cover all generic and specific features described herein, as well as all statements of the scope of the present method and system, which, as a matter of language, might be said to fall therebetween.

What is claimed is:

1. A metallic glass-forming alloy having a composition represented by the following formula:

$$(Zr_{1-y}Hf_y)_{1-xo}Z_{xo} \quad (1)$$

wherein:

y is at least 0.001 and not greater than 0.05; and

Z is one of

Ni with $0.30<xo<0.60$,

Co with $0.25<xo<0.50$, or

Fe with $0.20<xo<0.40$.

2. The metallic glass-forming alloy of claim 1, wherein the mass ratio of Hf:Zr is at least 1:500.

3. The metallic glass-forming alloy of claim 1, wherein the alloy has a critical rod diameter of at least 1 mm.

4. A metallic glass having the composition of the alloy of claim 1.

* * * * *